United States Patent [19]

Calcagni et al.

[11] Patent Number: 4,839,935

[45] Date of Patent: Jun. 20, 1989

[54] MINI ARCHED BRIDGE

[75] Inventors: Robert A. Calcagni, Poland; Alexander Sheppa, Hubbard, both of Ohio

[73] Assignee: Commercial Shearing, Inc., Youngstown, Ohio

[21] Appl. No.: 73,074

[22] Filed: Jul. 13, 1987

[51] Int. Cl.[4] ..... E01D 15/12

[52] U.S. Cl. ..... 14/24

[58] Field of Search ..... 14/1, 2, 9, 10, 11, 14/12, 24, 69.5, 73, 3; 404/35, 40; 182/113, 222, 223; 52/582, 87

[56] References Cited

U.S. PATENT DOCUMENTS

| | | | |
|---|---|---|---|
| 501,969 | 7/1893 | Stephens | 14/25 |
| 743,946 | 11/1903 | Spaulding | 52/87 |
| 1,147,378 | 7/1915 | Cronkhite | 52/582 X |
| 1,660,421 | 2/1928 | Knight | 404/40 |
| 2,284,022 | 5/1942 | Schmeller, Sr. | 14/69.5 |
| 2,826,771 | 3/1958 | Pruess, Sr. | 14/69.5 |
| 2,927,396 | 3/1960 | Hall, Jr. | 14/1 |
| 3,027,580 | 4/1962 | Haack | 14/69.5 |
| 3,768,108 | 10/1973 | Wadsworth | 14/24 |
| 3,894,307 | 7/1975 | Delamare | 14/27 |
| 4,161,089 | 7/1979 | Omansky | 52/585 X |
| 4,376,596 | 3/1983 | Green | 404/35 |

FOREIGN PATENT DOCUMENTS

| | | | |
|---|---|---|---|
| 2570400 | 3/1986 | France | 14/3 |
| 703068 | 1/1954 | United Kingdom | 14/1 |
| 2139672 | 11/1984 | United Kingdom | 14/3 |

*Primary Examiner*—Jerome W. Massie, IV
*Assistant Examiner*—Matthew Smith
*Attorney, Agent, or Firm*—Thomas R. Shaffer

[57] ABSTRACT

A mini arched bridge is provided with at leat two hollow pans having integral depending sides and ends forming a unitary structure, each side and end of the pans having comparable holes, a plurality of fasteners passing through the holes in adjacent ends of said at least two pans whereby said pans become a single arched member and placing the ends remote from the connection into the earth on opposite sides of the arc to be bridged.

14 Claims, 2 Drawing Sheets

MINI ARCHED BRIDGE

This invention relates to mini arched bridges and particularly to a method and bridge construction which is rapid, efficient and inexpensive particularly for golf courses and the like.

Mini bridges have been proposed in the past for various types of passageways over a watercourse or a gap in the terrain such as a gully or wash. Among such bridges are those shown in Hall U.S. Pat. No. 2,927,396, Wadsworth U.S. Pat. No. 3,768,108 and Delamare U.S. Pat. No. 3,894,307.

The Hall U.S. Pat. No. 3,927,396 discloses a toy bridge which requires a pair of vertical support members, a flat central separate portion and two inclined apron or entrance portions, all connected and supported by the vertical support members. This is, of course, very undesirable because of the necessity for vertical support members. Wadsworth U.S. Pat. No. 3,768,108 is made up of a plurality of arched metal angles, interfitting to form a channel, with strengthening cross members spaced lengthwise along this formed channel and a plurality of cross planks forming the travel surface of the bridge. This structure is objectionable because of the very large number of pieces required in a very short bridge. Finally, Delamare U.S. Pat. No. 3,894,307 relates to a bridge made of semi rigid inflatable members used for laying down a temporary bridge, over which are placed a plurality of rigid plates connected together end to end to form an arched roadway surface on top of the inflatable envelope. This again has many disadvantages, being based on inflatable pieces and a multitude of plate members connected together.

The present invention provides a very simple solution to this problem without the need for many parts. It is based up on an arcuate metal pan having downwardly extending sides and ends which give it strength and at the same time make it possible to connect together a multiplicity of like arcuate pans to provide the desired length and width.

This invention provides at least two arcuate pan shaped members having an arcuate outer surface and integral depending sides and ends, said ends of said at least two arcuate members being connected by fastening members passing through holes therein, a base member at the end of each pan shaped member remote from the connection. Preferably the arcuate surfaces are coated with anti-skid material over the whole width or over narrow travel lanes thereon. The mini bridge structure may be provided with strengthening tie members across the two end pans from holes in the side edges of each. The bridge may be widened by placing side by side pans and bolting through holes in the depending edges. There may also be provided rails and decorator parts assembled in said bridge.

In the foregoing statement certain objects, advantages and purposes of this invention have been set out. Other objects, purposes and advantages will be apparent from a consideration of the following description and the accompanying drawings in which FIG. 1 is an isometric drawing of a pan member according to this invention;

Figure 1:
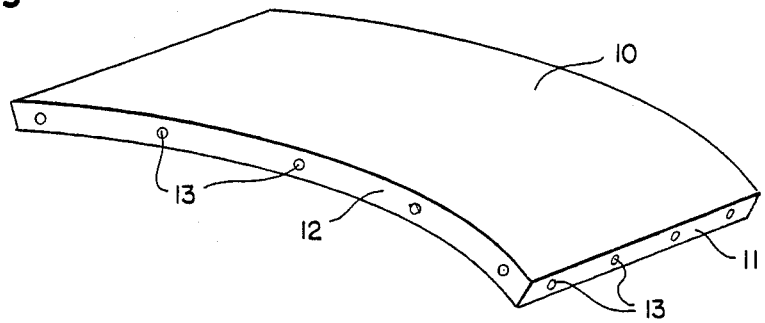
Figure 2:
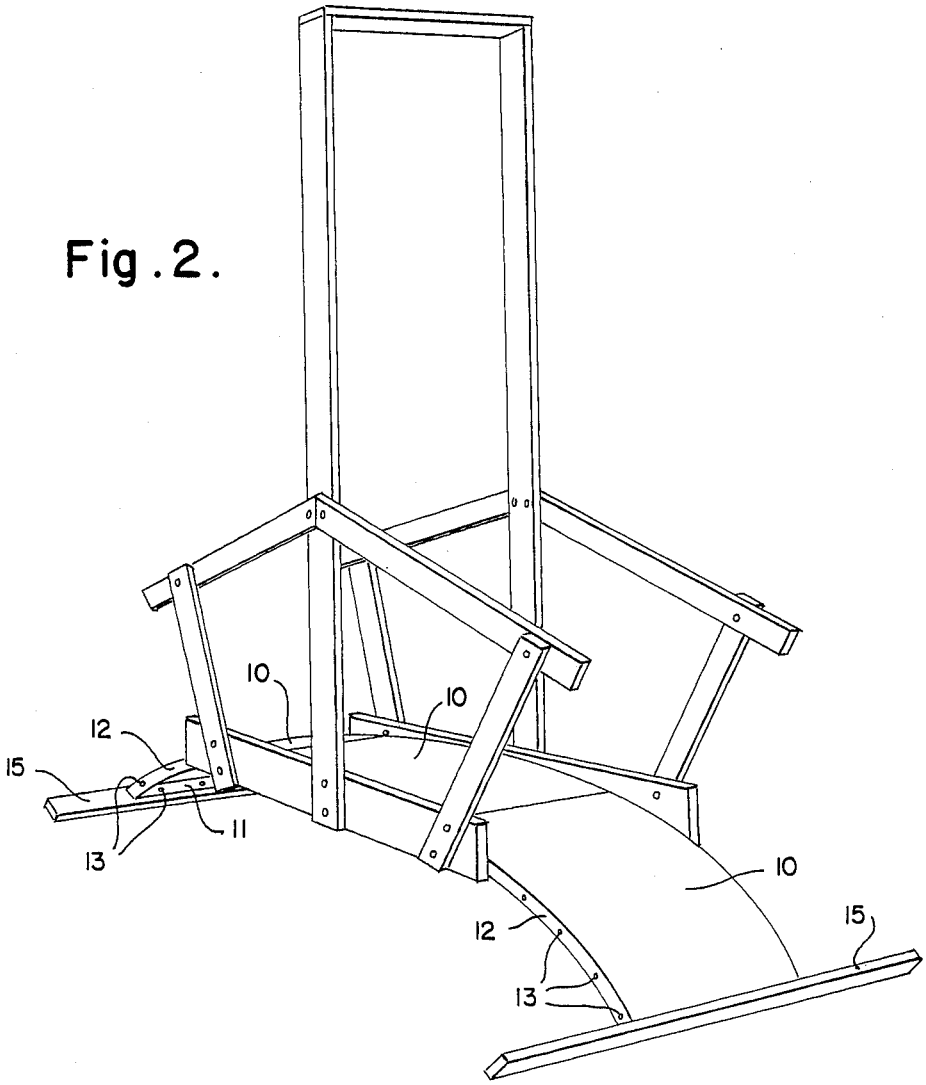
FIG. 2 is an isometric drawing of a mini bridge according to this invention incorporating three pan members.

Referring to the drawing, I have illustrated in FIG. 1, a pan member made up of a body portion 10, depending end portions 11 and side portions 12, each having holes 13 by means of which they can be bolted together end to end in a single span or side by side and end to end to form a double span.

Preferably the two end arcuate members 10 have a base member 15 attached by bolts to the end openings 13 to form a broader base to prevent shifting of the structure when in place, as, for example, over a small stream.

Figure 3:
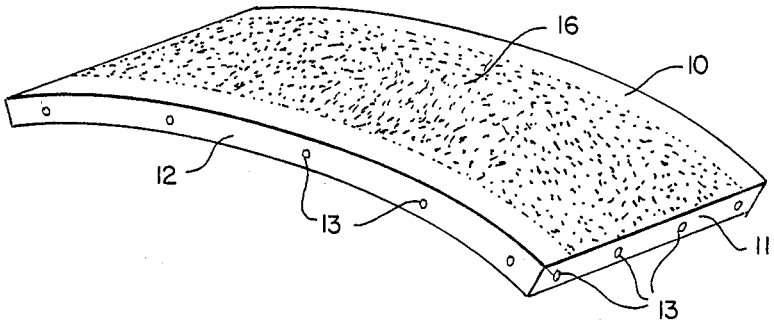
FIG. 3 is an isometric view of the bridge pan of FIG. 2 showing a coating of anti skid material on said pan members making up the bridge.
Figure 4:
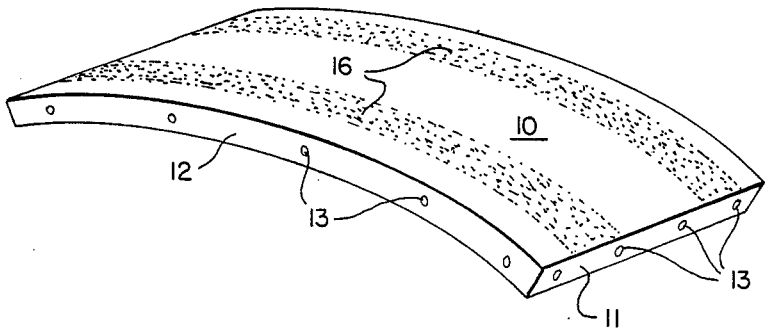
FIG. 4 is an isometric view showing two narrow coatings of anti skid material making up a travel surface on said bridge.

The upper contact surfaces may be coated with an anti skid material 16 such as sand or carborundum as shown in FIG. 3 or they may have narrow tracks of anti skid material 16 as shown in FIG. 4.

Figure 5:
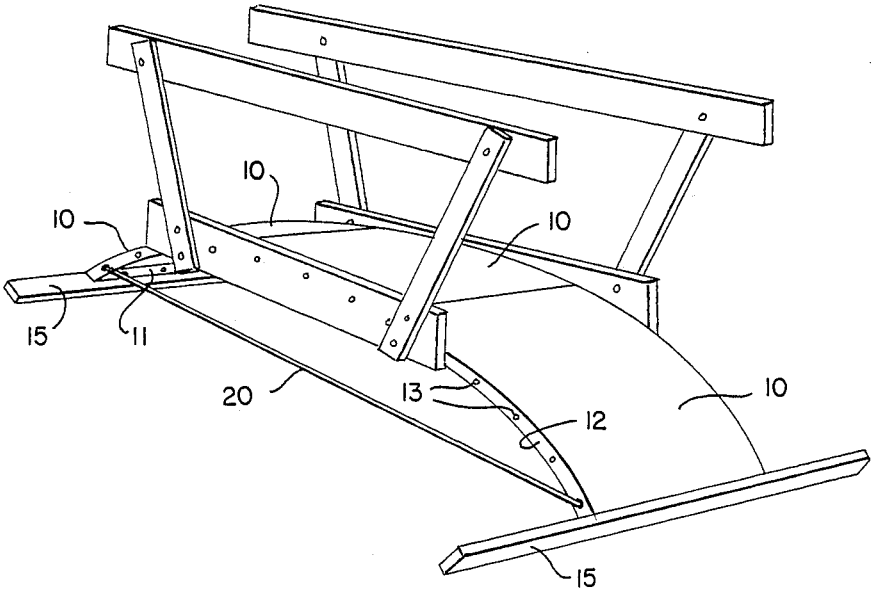
FIG. 5 is an isometric view showing the bridge of FIG. 2 with the tie member or stabilizer in place.

To provide added strength where heavier loads are expected a tie member 20 may be provided as shown in FIG. 5. This provides greater strength, particularly against the ends becoming deformed, when heavier loads might be expected. It may be a cable or a rod.

This invention has particular utility in golf courses, parks, estate and the like where an inexpensive yet strong mini bridge is desired.

In the foregoing specification, certain preferred embodiments and practices of this invention have been set out, however, it will be understood that this invention may be otherwise embodied within the scope of the following claims.

We claim:

1. A mini arched bridge comprising at least two rigid hollow pans having integral downwardly depending ends and sides forming a unitary structure, each of said pans having an arcuate upper surface arching upwardly in use to support downward loads thereon, said at least two arched pans forming the entire upper surface of said bridge, said ends and sides of each pan extending completely around the perimeter of the pan to provide increased strength and rigidity to the pan and each side and end having comparable holes, a plurality of fasteners passing through the holes in the adjacent ends of each of said at least two pans, and, the ends remote from the connection adapted for placement into the earth on opposite sides of an area to be bridged, whereby said pans become a single arched member.

2. A mini arched bridge as claimed in claim 1 wherein the pans are of rigid metal.

3. A mini arched bridge as claimed in claim 1 or 2 where the upper surface of each pan is covered with anti skid material.

4. A mini arched bridge as claimed in claim 1 or 2 wherein said upper pan surfaces are coated in spaced areas from end to end with an anti skid material.

5. A mini arched bridge as claimed in claim 1 or 2 wherein said pan edges are bolted to a board member carrying hand rails and the like accessories.

6. A mini arched bridge as claimed in claim 3 wherein said pan edges are bolted to a board member carrying hand rails and the like accessories.

7. A mini arched bridge as claimed in claim 4 wherein said pan edges are bolted to a board member carrying hand rails and the like accessories.

8. A mini arched bridge as claimed in claims 1 or 2 wherein the pan edges at the remote ends are connected to a base member, said base member being broader than said bridge whereby shifting of the bridge is reduced.

9. A mini arched bridge as claimed in claim 3 wherein the pan edges at the remote ends are connected to a base member, said base member being broader than said bridge whereby shifting of the bridge is reduced.

10. A mini arched bridge as claimed in claim 4 wherein the pan edges at the remote ends are connected to a base member, said base member being broader than said bridge whereby shifting of the bridge is reduced.

11. A mini arched bridge as claimed in claims 1 or 2 having a tie member extending in a straight line completely beneath and spaced from said single arched member in at least a central portion thereof and connecting the sides at the two remote ends.

12. A mini arched bridge as claimed in claim 3 having a tie member extending in a straight line completely beneath and spaced from said single arched member in at least a central portion thereof and connecting the sides at the two remote ends.

13. A mini arched bridge as claimed in claims 4 having a tie member extending in a straight line completely beneath and spaced from said single arched member in at least a central portion thereof and connecting the sides at the two remote ends.

14. A mini arched bridge as claimed in claim 11 wherein the tie member is a cable.

* * * * *

UNITED STATES PATENT AND TRADEMARK OFFICE

CERTIFICATE OF CORRECTION

PATENT NO. : 4,839,935

DATED : June 20, 1989

INVENTOR(S) : ROBERT A. CALCAGNI, ALEXANDER SHEPPA

It is certified that error appears in the above-identified patent and that said Letters Patent is hereby corrected as shown below:

At 57, Abstract, line 1, change "leat" to --least--.

Column 2, claim 1 should read:

--1. A mini arched bridge comprising at least two rigid hollow pans having integral depending ends and sides forming a unitary structure, each of said pans having an arcuate outer surface adapted to arch upwardly in use to support downward loads thereon, said ends and sides of each pan extending completely around the perimeter of the pan to provide increased strength and rigidity to the pan and each side and end having comparable holes, a plurality of fasteners passing through the holes in the adjacent ends of each of said at least two pans, and the ends remote from the connection adapted for placement into the earth on opposite sides of an area to be bridged, whereby said pans become a single arched member.--

Column 3, claim 11 should read:

--11. A mini arched bridge as claimed in claims 1 or 2 having a tie member extending in a straight line and connecting the sides at the two remote ends.--

Column 4, claim 12 should read:

--12. A mini arched bridge as claimed in claim 3 having a tie member extending in a straight line and connecting the sides at the two remote ends.--

Column 4, claim 13 should read:

UNITED STATES PATENT AND TRADEMARK OFFICE

CERTIFICATE OF CORRECTION

PATENT NO. : 4,839,935

DATED : June 20, 1989

INVENTOR(S) : Robert A. Calcagni, Alexander Sheppa

It is certified that error appears in the above-identified patent and that said Letters Patent is hereby corrected as shown below:

--13. A mini arched bridge as claimed in claim 4 having a tie member extending in a straight line and connecting the sides at the two remote ends.--

Signed and Sealed this

Sixth Day of November, 1990

*Attest:*

HARRY F. MANBECK, JR.

*Attesting Officer*

*Commissioner of Patents and Trademarks*